US006780044B1

(12) United States Patent
Sawyer et al.

(10) Patent No.: US 6,780,044 B1
(45) Date of Patent: Aug. 24, 2004

(54) SPLICE CONNECTOR ASSEMBLIES AND METHODS FOR USING THE SAME

(75) Inventors: Charlie Sawyer, Orlando, FL (US); Isaac White, Orlando, FL (US); James Dickens, Ocoee, FL (US); Blake Urban, Lenoir, NC (US); Kevin Forsberg, Orlando, FL (US)

(73) Assignee: Bellsouth Intellectual Property, Wilmington, DE (US)

( * ) Notice: Subject to any disclaimer, the term of this patent is extended or adjusted under 35 U.S.C. 154(b) by 4 days.

(21) Appl. No.: 10/429,521

(22) Filed: May 5, 2003

(51) Int. Cl.[7] ..... H01R 11/20
(52) U.S. Cl. ..... 439/417; 439/404; 200/61.62
(58) Field of Search ..... 439/417, 404, 439/395, 405; 200/16 A, 550, 61.62, 336

(56) References Cited

U.S. PATENT DOCUMENTS

| | | | | |
|---|---|---|---|---|
| 4,435,034 A | | 3/1984 | Aujla et al. | 439/404 |
| 4,806,711 A | * | 2/1989 | Eckhaus | 200/61.62 |
| 6,541,723 B1 | * | 4/2003 | Rao et al. | 200/336 |

OTHER PUBLICATIONS

U S patent application Ser. No. 10 330,454. filed Dec. 28, 2002.

* cited by examiner

*Primary Examiner*—Tho D. Ta
(74) *Attorney, Agent, or Firm*—Myers Bigel Sibley & Sajovec, P.A.

(57) ABSTRACT

A splice connector assembly for mechanically and selectively electrically connecting first and second conductor members includes a connector body adapted to receive the first and second conductor members. The connector body includes a first body member and a second body member adapted to engage the first body member. First and second electrically conductive terminals in the connector body are adapted to electrically engage the first and second conductor members, respectively. An electrically conductive bridge member is mounted in the connector body such that the bridge member is movable between a closed position, wherein the bridge member electrically connects the first and second terminals and thereby the first and second conductor members, and an open position, wherein the bridge member does not electrically connect the first and second terminals so that the first and second conductor members are not electrically connected by the splice connector assembly. The splice connector assembly is arranged and configured to crimp the first conductor member to the first terminal when the first and second body members are engaged with the first conductor member positioned therebetween. According to some embodiments, the first terminal of the splice connector assembly described above includes an insulation displacement connector.

53 Claims, 5 Drawing Sheets

SPLICE CONNECTOR ASSEMBLIES AND METHODS FOR USING THE SAME

FIELD OF THE INVENTION

The present invention relates to electrical connectors and, more particularly, to splice connectors.

BACKGROUND OF THE INVENTION

Connectors are used throughout the telecommunications and electronics industries in general to connect wires or other conductor members. Such connectors may allow one wire or conductor member to be spliced or electrically connected to another wire or conductor member. Although these connectors are used throughout the electronics industry, such connectors are particularly suited for connection of the "ring and tip" connectors of telephone systems. The conductor members to be connected are typically inserted into the connector and the connector is crimped or clamped to electrically connect the wires.

Although there are many existing connectors of varying designs, these prior art connectors have disadvantages. Some prior art connectors, for example, have no means for testing the connected wires. If an operator must test the connection or the wires after a connector has been installed, for example by crimping, the operator must first cut the connector from one or more of the wires. The wires typically must then be stripped of their outer insulation to allow the operator to take measurements such as current and/or voltage measurements. If the operator determines that no problem is present at the connector or in the tested wires, then the connection has been unnecessarily destroyed. Typically, the operator must then install a new connector. Accordingly, troubleshooting wires connected using connectors of such prior art designs may be a slow task in which many functioning connectors are wasted.

SUMMARY OF THE INVENTION

According to embodiments of the present invention, a splice connector assembly for mechanically and selectively electrically connecting first and second conductor members includes a connector body adapted to receive the first and second conductor members. The connector body includes a first body member and a second body member adapted to engage the first body member. First and second electrically conductive terminals in the connector body are adapted to electrically engage the first and second conductor members, respectively. An electrically conductive bridge member is mounted in the connector body such that the bridge member is movable between a closed position, wherein the bridge member electrically connects the first and second terminals and thereby the first and second conductor members, and an open position, wherein the bridge member does not electrically connect the first and second terminals, such that the first and second conductor members are not electrically connected by the splice connector assembly. The splice connector assembly is arranged and configured to crimp the first conductor member to the first terminal when the first and second body members are engaged with the first conductor member positioned therebetween.

According to some embodiments, the first terminal of the splice connector assembly described above includes an insulation displacement connector. The first body member, the second body member, and the first terminal may be relatively arranged and configured to push the first conductor member into the insulation displacement connector when the first body member and the second body member are forced into engagement with the first conductor member positioned therebetween.

The splice connector assembly may also be arranged and configured to crimp the second conductor member to the second terminal. The second terminal may include a second insulation displacement connector. According to some embodiments, the connector body includes a third body member adapted to engage the first body member, and the splice connector assembly is arranged and configured to crimp the second conductor member to the second terminal when the first and third body members are engaged with the second conductor member positioned therebetween. The first and second terminals may extend from opposite sides of the first body member.

The splice connector may further include: third and fourth electrically conductive terminals in the connector body adapted to electrically engage third and fourth conductor members, respectively; and a second electrically conductive bridge member mounted in the connector body such that the second bridge member is movable between a closed position, wherein the bridge member electrically connects the third and fourth terminals and thereby the third and fourth conductor members, and an open position, wherein the second bridge member does not electrically connect the third and fourth terminals, such that the third and fourth conductor members are not electrically connected by the splice connector assembly. The splice connector assembly is arranged and configured to crimp the third conductor member to the third terminal when the first and second body members are engaged with the third conductor member positioned therebetween. The third terminal may include a third insulation displacement connector.

The bridge member may be mounted in the connector body such that the bridge member can be translated between the open and closed positions. The bridge member may be rotatably mounted in the connector body such that the bridge member can be rotated between the open and closed positions.

According to further embodiments of the present invention, a method for splicing and selectively electrically connecting and disconnecting first and second conductor members using a splice connector assembly including a connector body and first and second electrically conductive terminals and a bridge member mounted in the connector body, the connector body including first and second body members, is provided. The method includes: inserting the first and second conductor members into the connector body between the first and second body members; electrically engaging the first and second conductor members with the first and second terminals, respectively; electrically connecting the first and second conductor members by placing the bridge member in a closed position wherein the bridge member electrically connects the first and second terminals; and thereafter electrically disconnecting the first and second conductors by placing the bridge member in an open position wherein the bridge member does not electrically connect the first and second terminals. The step of engaging the first and second conductor members with the first and second terminals includes engaging the first and second body members such that the first conductor member is crimped to the first terminal.

According to further embodiments of the present invention, a splice connector assembly for mechanically and selectively electrically connecting first and second conductor members includes a connector body adapted to receive the first and second conductor members. The connector body includes a first body member and a second body member adapted to engage the first body member. First and second electrically conductive terminals in the connector body are adapted to electrically engage the first and second conductor members, respectively. An electrically conductive bridge member is mounted in the connector body such that the bridge member is movable between a closed position, wherein the bridge member electrically connects the first and second terminals and thereby the first and second conductor members, and an open position, wherein the bridge member does not electrically connect the first and second terminals, such that the first and second conductor members are not electrically connected by the splice connector assembly. The first terminal of the splice connector assembly includes an insulation displacement connector.

According to further embodiments of the present invention, a method for splicing and selectively electrically connecting and disconnecting first and second conductor members using a splice connector assembly including a connector body and first and second electrically conductive terminals and a bridge member mounted in the connector body, the connector body including first and second body members, is provided. The method includes: inserting the first and second conductor members into the connector body between the first and second body members; electrically engaging the first and second conductor members with the first and second terminals, respectively; electrically connecting the first and second conductor members by placing the bridge member in a closed position wherein the bridge member electrically connects the first and second terminals; and thereafter electrically disconnecting the first and second conductors by placing the bridge member in an open position wherein the bridge member does not electrically connect the first and second terminals. The first terminal includes an insulation displacement connector, and the step of engaging the first and second conductor members with the first and second terminals includes forcing the first conductor member into the insulation displacement connector.

The present invention will be appreciated by those of ordinary skill in the art from a reading of the figures and the detailed description of the preferred embodiments which follow, such description being merely illustrative of the present invention.

DETAILED DESCRIPTION OF THE PREFERRED EMBODIMENTS

Figure 1:
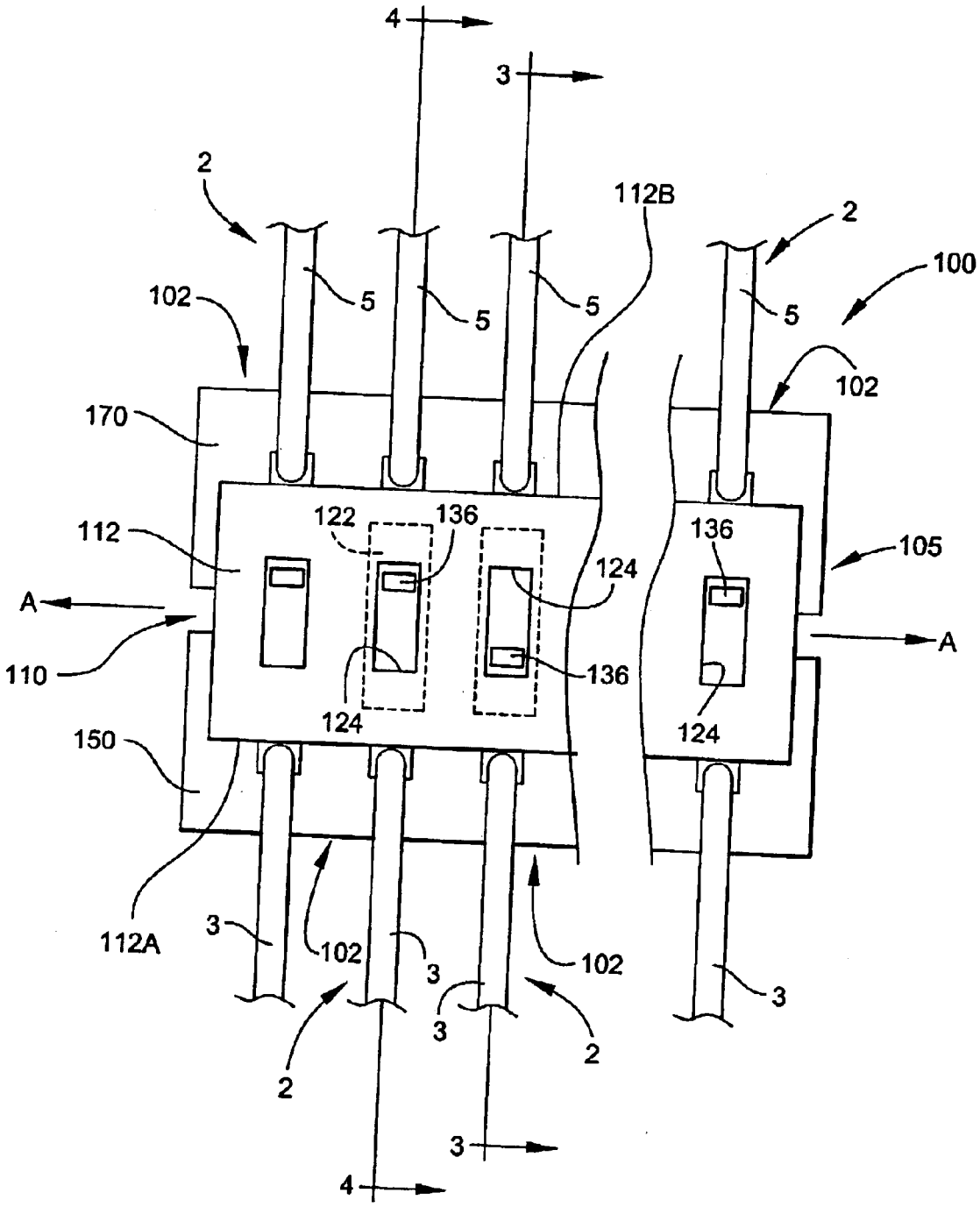
FIG. 1 is a top view of a splice connector assembly according to embodiments of the present invention along with multiple pairs of conductor members, such as wires, spliced together by the splice connector assembly.

The present invention now will be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the relative sizes of regions may be exaggerated for clarity. It will be understood that when an element such as a layer, region or substrate is referred to as being "on" or "connected to" another element, it can be directly on or directly connected to the other element or intervening elements may also be present. In contrast, when an element is referred to as being "directly on" or "directly connected to" another element, there are no intervening elements present.

As used herein, "crimping" and variants thereof as used with reference to a conductor member and a terminal means that at least a portion of the conductor member (such as an inner metallic conductor or a surrounding insulation sleeve) is deformed or displaced to provide mechanical engagement (and, thus, electrical contact) between the conductor member and the terminal.

With reference to FIG. 1, a splice connector assembly 100 according to embodiments of the present invention is shown therein. The splice connector assembly 100 includes a connector body 105 having three body members, namely, a base 110 and a pair of caps 150, 170. The splice connector assembly 100 includes a plurality of splice sections or locations 102, each adapted to mechanically and electrically connect a respective pair 2 of conductor members 3, 5 as shown in FIG. 1. More particularly, the conductor pairs 2 are installed in the splice connector assembly 100 between the base 110 and the caps 150, 170. While four conductor pairs 2 are shown, the splice connector assembly 100 may be configured to receive and connect more or fewer conductor pairs. For example, according to some embodiments, the splice connector assembly 100 is adapted to connect ten or more conductor pairs, and, according to some embodiments, the splice connector assembly 100 may be adapted to connect twenty-five pairs of conductor members. As discussed in greater detail below, the splice connector assembly 100 is adapted to mechanically and selectively electrically connect the respective conductor members of each conductor pair 2 to one another.

Figure 3:
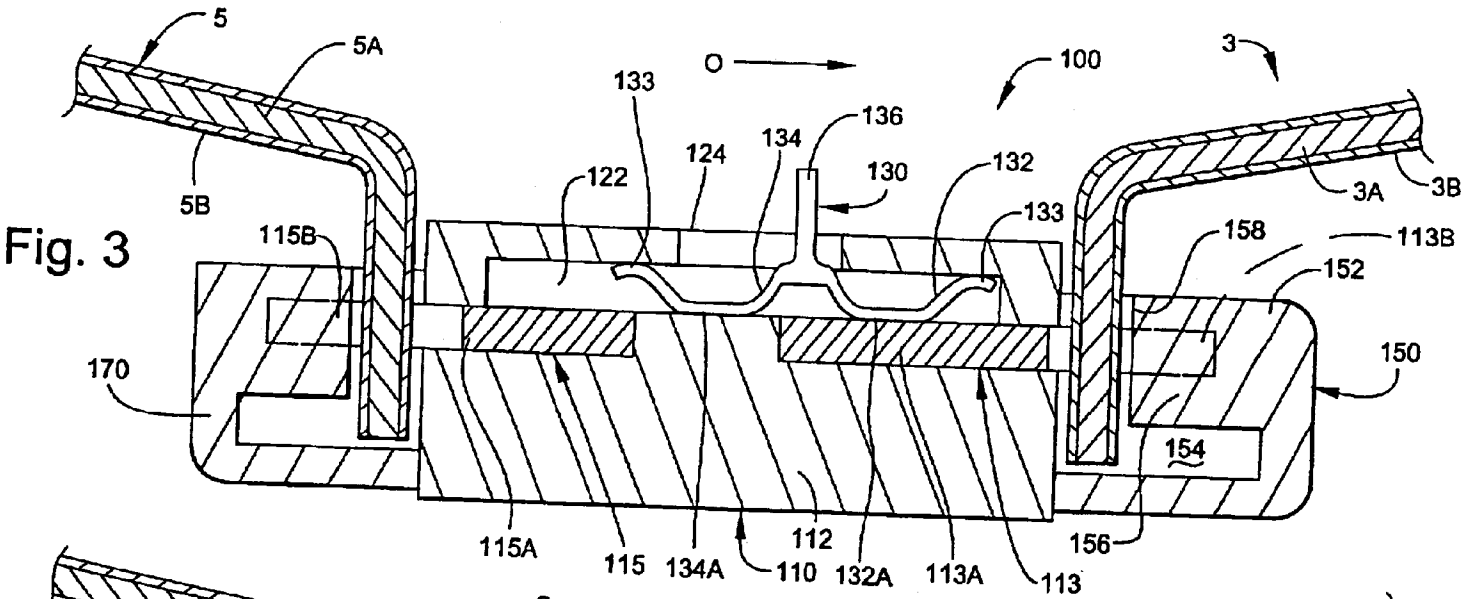
FIG. 3 is a cross-sectional view of the splice connector assembly of FIG. 1 taken along the line 3—3 of FIG. 1.

Each conductor member 3, 5 may include an electrically conductive portion 3A, 5A formed of metal (e.g., copper) or the like, and an electrically insulative sleeve 3B, 5B, for example, formed of a polymeric material (FIG. 3). The splice connector assembly 100 may be used to splice low voltage wires from a telecommunications facility (i.e., a company or supply side) to wires leading to a customer facility (i.e., an output side) such as a home or business. There may be further splices or other devices between the splice connector assembly 100 and the telecommunications facility and/or the customer facility. The splice connector assembly 100 may be located in any suitable location, such as in an underground or above-ground terminal box or in a network interface device (NID).

Figure 2:
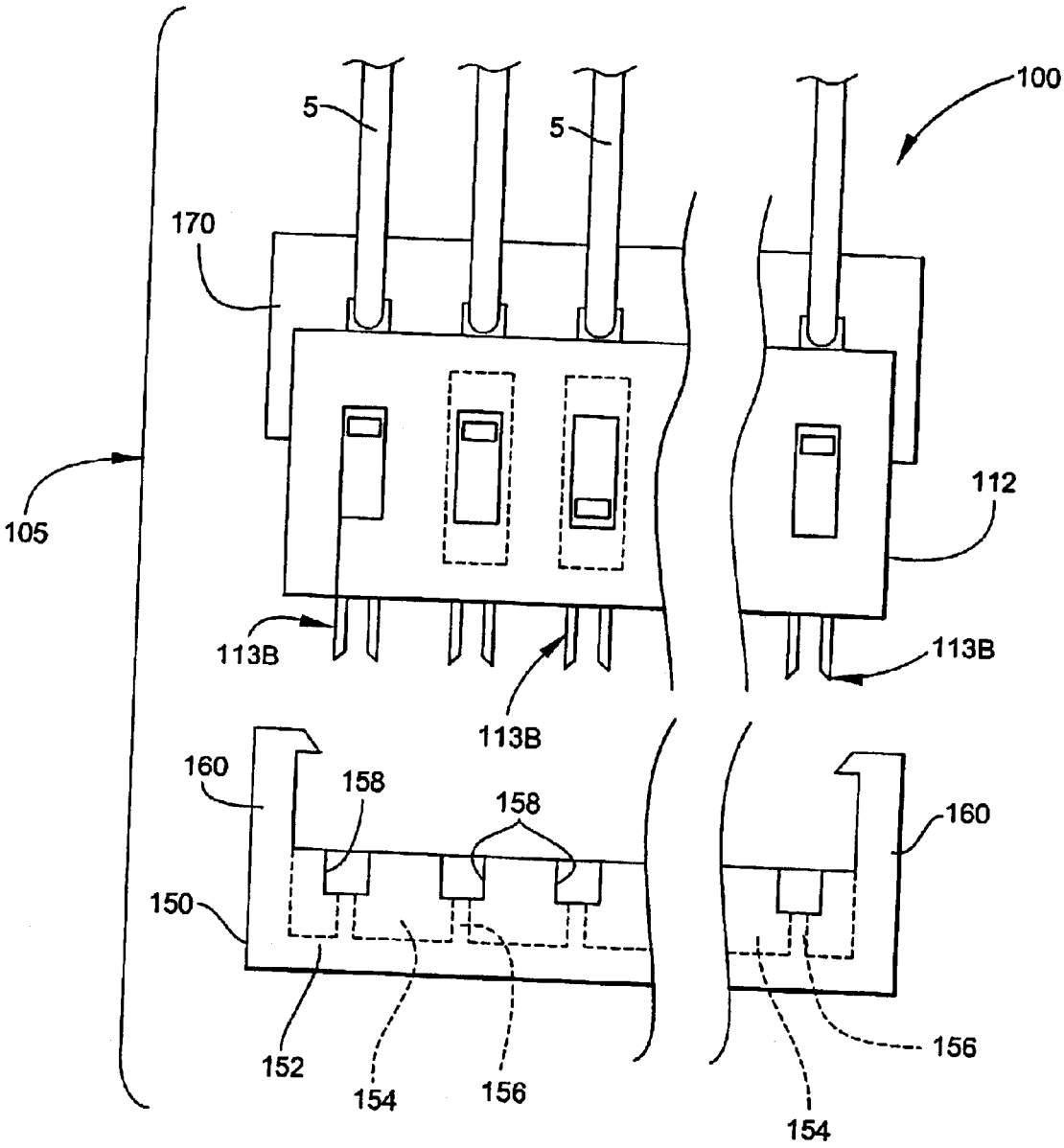
FIG. 2 is an exploded view of the splice connector assembly of FIG. 1 wherein only one conductor member of each conductor member pair is installed in the splice connector assembly.
Figure 4:
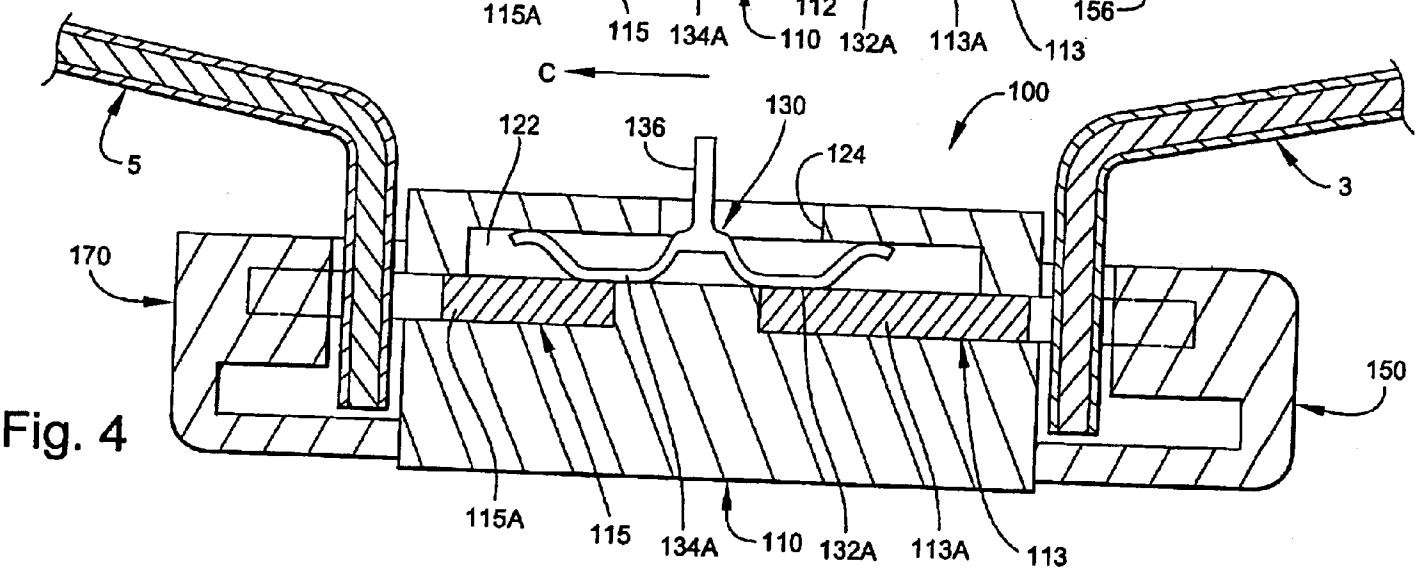
FIG. 4 is a cross-sectional view of the splice connector assembly of FIG. 1 taken along the line 4—4 of FIG. 1.

The splice connector assembly 100 is further illustrated in FIGS. 2–4. In FIG. 2, the cap 150 is shown disassembled from the base 110 and only the conductor members 5 of each conductor pair 2 are installed.

The caps 150 and 170 may be substantially identical; accordingly, the following description of the cap 150 likewise applies to the cap 170. The cap 150 includes a body portion 152 defining a plurality of inwardly opening cavities 154. The cavities 154 are partitioned from one another by push walls 156, which terminate adjacent inwardly and upwardly opening slots or cutouts 158. A pair of latch arms 160 extend forwardly from the body portion 152 to permanently or removably secure the cap 150 to the base 110. Additional latches or other features may be provided to secure the caps 150, 170 to the base 110. For example, the caps 150, 170 could be connected to the base 110 by live hinges. The caps 150, 170 are preferably formed of a strong, resilient, electrically insulative material. According to some embodiments, the caps 150,170 are formed of a molded polymeric material.

As best seen in FIG. 3, the base 110 includes a body 112. The body 112 has an axis A—A and first and second opposed sides 112A and 112B on either side of the axis A—A. The body 112 is preferably formed of a strong, resilient, electrically insulative material such as a molded polymeric material. A pair of opposed terminals 113, 115 are permanently secured in the body 112 at each splice location 102. Each of the terminals 113, 115 includes a contact portion 113A, 115A and a crimping portion 113B, 115B integral with the respective contact portion 113A, 115A. According to some embodiments and as illustrated, each of the crimping portions 113B, 115B is an insulation displacement terminal or an insulation displacement connector (IDC). Each of the IDCs includes a pair of cantilevered legs or tines defining a slot therebetween. The slot and the tines are sized and shaped to cut away or otherwise displace the insulation 3B or 5B of an appropriately sized conductor member such that the tines make secure contact with the metal conductor of the conductor member. The tines may thereby be somewhat separated so that they are biased against the conductive portion 3A or 5A of the conductor member. Suitable IDC configurations will be apparent to those of ordinary skill in the art upon reading the description herein. The IDCs 113B, 115B extend outwardly from the body 112 to receive the respective conductor members 3, 5 as discussed below. The terminals 113, 115 are preferably formed of a suitable electrically conductive metal such as copper.

With reference to FIGS. 1, 3 and 4, a slide slot 122 is defined in the body 112 at each splice location 102. An opening 124 extends from each slot 122 to the top surface of the base 110.

A bridge member 130 is mounted in each slide slot 122. Each bridge member 130 includes a pair of joined, opposed legs 132, 134 and a tab portion 136. The legs 132, 134 are slidably captured in the slot 122, while the tab portion 136 extends out of the base 110 through the opening 124. Alternatively, the tab portion 136 may be replaced with other means for manipulating the bridge member 130 through the opening 124. For example, the bridge member 130 may include a slot, recess or detent formed therein. The tab portion 136 or other suitable feature can be used to slide the bridge member 130 back and forth along the slot 122 as indicated by the arrows O (FIG. 3) and C (FIG. 4). The bridge member 130 may be integrally formed of copper, steel or other suitable electrically conductive material. According to some embodiments and as shown, the legs 132, 134 are configured such that they are spring loaded (i.e., maintained in elastic compression) so that contact portions 132A, 134A thereof are urged downwardly and end portions 133 thereof bear against the upper surface of the slot 122.

The splice connector assembly 100 may be used in accordance with methods of the present invention as follows. Conductor members 3, 5 of the conductor pairs 2 to be spliced are secured to the splice connector assembly 100. More particularly, each of the conductor members 3, 5 is placed at or partially into its respective IDC 113B, 115B from and along the associated side 112A or 112B of the body 112. The associated cap 150, 170 is then pushed onto the base 110 and over the IDCs 113B or 115B. The push walls 156 push the adjacent conductor members 3, 5 into the IDCs 113B, 115B and may themselves be received in the IDCs 113B, 115B. As the conductor members 3, 5 enter the IDCs, the IDCs cut through the insulation sleeves 3B, 5B to make electrical contact with the metal conductor portions 3A, 5A. Notably, it is not necessary to strip the insulation 3B, 5B from the conductor portions 3A, 5A prior to inserting the conductor members 3, 5 into the IDCs 113B, 115B. The caps 150, 170 may be forced onto the base 110 by hand or using a suitable crimping tool.

In this manner, the conductor members 3, 5 are crimped to the respective terminals 113, 115. The IDCs 113B, 115B are received in the cavities 154 and the conductor members 3, 5 are received in the slots 158. The latch arms 160 retain the caps 150, 170 in position, thereby securely locking the conductor members 3, 5 to the splice connector assembly 100. The same method of assembly may be used for both sides of the splice connector assembly 100 (i.e., the cap 150 and the cap 170) sequentially or in tandem.

According to some embodiments, the foregoing assembly serves to substantially permanently secure the conductor members 3, 5 to the splice connector assembly 100. According to some embodiments, the conductor members 3, 5 once installed in the splice connector assembly 100 cannot be removed from the splice connector assembly without cutting the conductor members 3, 5 or destroying the conductor members 3, 5 or the splice connector assembly 100 in full or in part. The mechanical securement of the conductor members 3, 5 provided by the IDCs 113B, 115B may be supplemented by the features and engagement between the base 110 and the caps 150, 170.

Once the conductor pairs 2 have been installed as described above, it may thereafter be desirable or necessary to electrically connect or disconnect the conductor members 3, 5 of one or more of the pairs 2. With reference to FIGS. 1 and 3, a given conductor pair 2 can be disconnected by sliding the bridge member 130 in the direction O to an open position wherein the contact leg 134 is not in contact with the contact portion 115A of the terminal 115. In this manner, electrical continuity between the conductor members 3 and 5 of the selected conductor pair 2 is destroyed.

With reference to FIGS. 1 and 4, the conductor members 3A, 5A of a selected conductor pair 2 can be electrically connected by sliding the bridge member 130 in the direction C to a closed position, wherein the contact leg 134 makes contact with the contact portion 115A of the terminal 115. In this manner, electrical continuity between the conductor members 3, 5 is created.

In the foregoing manner, the splice connector assembly 100 can be used to connect and disconnect wires to activate and deactivate telephone lines, for example. The splice connector assembly 100 can be used to identify inoperable lines by disconnecting the splice in such a line and determining if any effect is caused (if not, then it may be deduced that the line of the conductor member pair in question already lacked continuity or a signal source either in the splice connector assembly 100 or elsewhere).

Advantageously, each conductor pair 2 can be connected and disconnected independently of the other conductor pairs or groups of pairs. Optionally, multiple conductor pairs can be grouped together so that a ganged group of bridge members or a single bridge member is operable to open and close multiple splice locations 102.

While a multiple splice connector assembly 100 is shown and described, splice connector assemblies in accordance with the present invention may include only a single conductor pair splice location 102.

Figure 5:
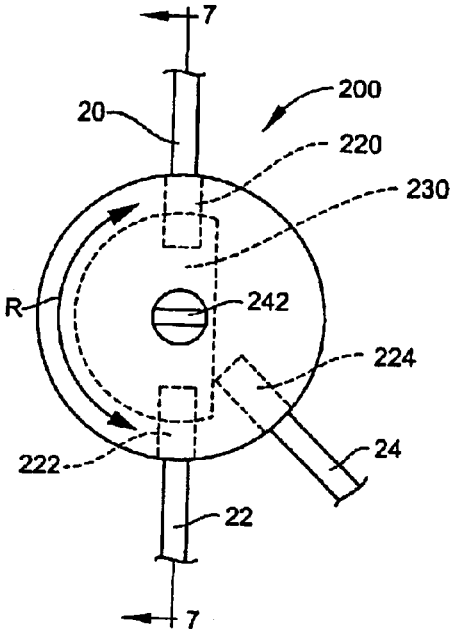
FIG. 5 is a top plan view of a splice connector assembly according to further embodiments of the present invention with three conductor members, such as wires, installed therein.
Figure 6:
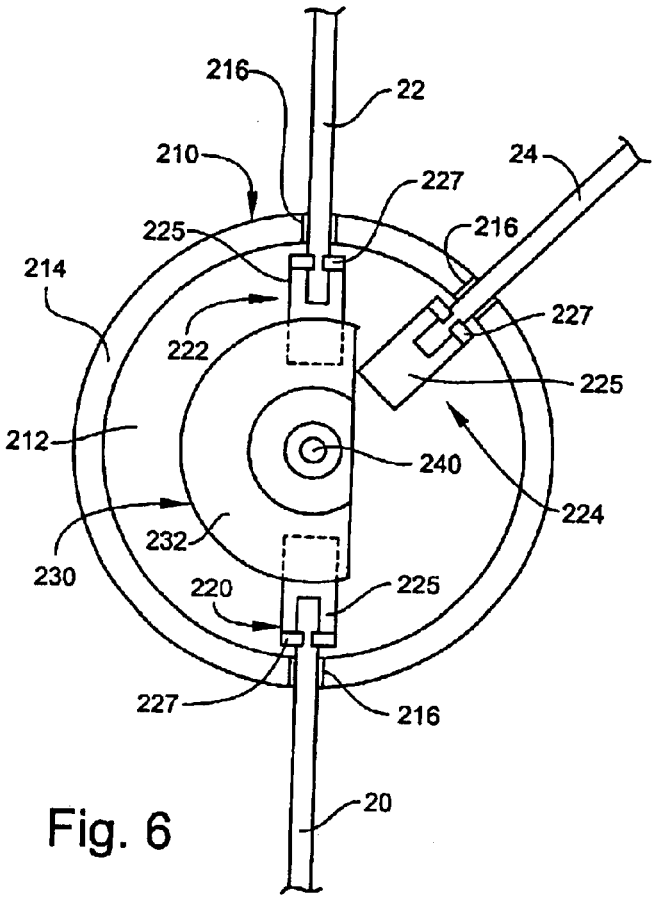
FIG. 6 is a bottom plan view of the splice connector assembly and conductor members of FIG. 5 with a cap of the splice connector assembly removed.
Figure 7:
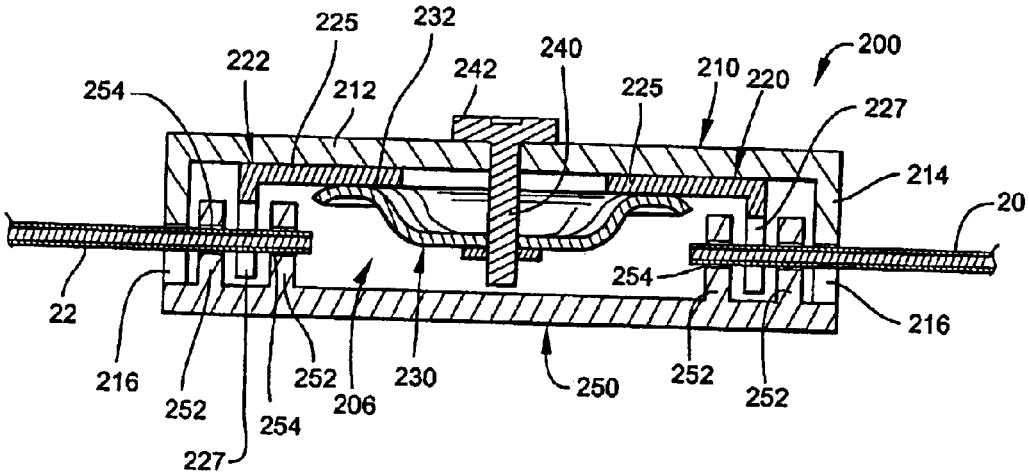
FIG. 7 is a cross-sectional view of the splice connector assembly and conductor members of FIG. 5 taken along the line 7—7 of FIG. 5.

With reference to FIGS. 5–11, a splice connector assembly 200 according to further embodiments of the present invention is shown therein. The splice connector assembly 200 is adapted to mechanically and selectively electrically connect three conductors 20, 22, 24. However, it will be appreciated from the discussion that follows that connectors in accordance with the present invention may be configured to connect more or fewer conductor members. The splice connector assembly 200 includes a base 210 and a cap 250 defining a cavity 206 (FIG. 7). The base 210 has an end wall 212 and a surrounding side wall 214. Slots 216 are formed in the side wall 214 to receive the conductor members 20, 22, 24. The base 210 is preferably formed of the same materials as described above for the base 110.

The cap 250 has upstanding walls 252. Radially extending holes 254 are formed through the walls 252 and are adapted to receive the conductor members 20, 22, 24. The relative placements of the sidewall 214 and the upstanding walls 252 and/or other features such as ribs and detents may be provided to secure the cap 250 to the base 210. According to some preferred embodiments, the base 210 and the cap 250 are substantially permanently joined once the splice connector 200 has been assembled as discussed below. The cap 250 is preferably formed of the same materials as described above with regard to the cap 150.

A plurality of terminals 220, 222, 224 are provided. Each of the terminals 220, 222, 224 has a contact portion 225 secured to the base 210 and a crimping portion such as an IDC 227 integral with the respective contact portion 225. The terminals 220, 222, 224 are preferably formed of the same materials as described above with regard to the terminals 113, 115.

A bridging member 230 is rotatably secured to the base 210 by a pivot member 240 such that the bridge member 230 can be rotated in either or both of a clockwise direction and a counterclockwise direction as indicated by the arrows R in FIG. 5. According to some embodiments, the bridge member 230 is joined to the pivot member 240 for rotation therewith. The pivot member 240 may have a head 242 with slots or other suitable features to operably engage a driver such as a screwdriver. According to some embodiments, the bridge member 230 is axially compressed (by the pivot member 240 or otherwise) against the base 210 such that a contact portion 232 of the bridge member 230 is spring-biased against the end wall 212 and one or more of the contact portions 235 as discussed below.

The splice connector assembly 200 may be assembled as follows. The conductor members 20, 22, 24 are inserted through the holes 254 of the cap 250 as shown in FIG. 7. The base 210 is forced onto the cap 250 so that the IDCs 227 are inserted between the walls 252 and over and about the respective conductive members 20, 22, 25. The walls 252 hold the conductors to ensure proper insertion into the IDCs 227. In this manner, the IDCs 227 cut through the insulation sleeves of the conductor members 20, 22, 24 and make contact with the inner conductor portions of the conductor members. Additionally, the base 210 and the cap 250 are latched together to form a unitary construction.

Figure 9:
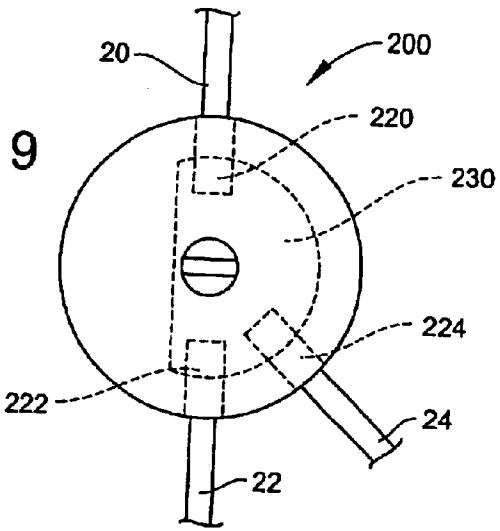
FIGS. 8–11 are top plan views of the splice connector assembly and conductor members of FIG. 5 wherein a bridge member thereof is illustrated in alternative positions.
Figure 11:
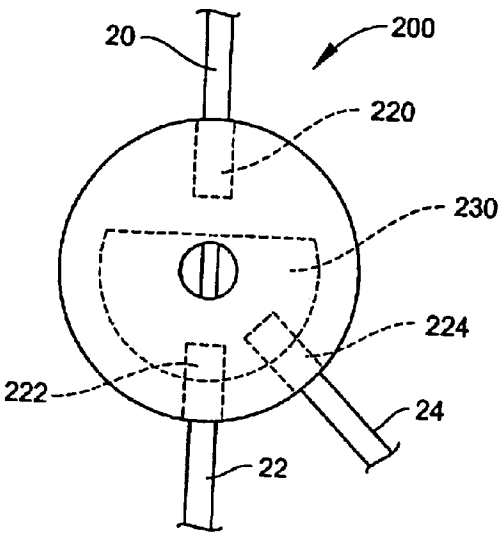
Figure 8:
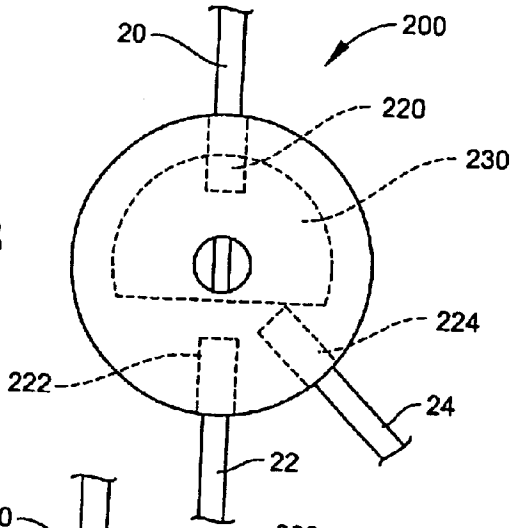
Figure 10:
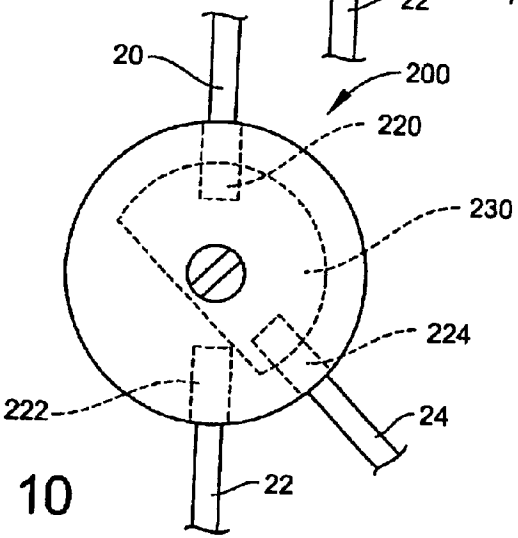

The conductor members 20, 22, 24 can thereafter be electrically connected and disconnected as desired or needed by placing the bridge member 230 in one of several rotative positions. In a first closed position as shown in FIGS. 5–7, the bridge member 230 bridges the terminals 220 and 222 to provide electrical continuity between the conductors 20 and 22. In a further position as shown in FIG. 8, the bridge member 230 is in a fully open position wherein it does not bridge any of the terminals 220, 222, 224 and thus electrical continuity is not provided between any of the conductor members 20, 22, 24. In FIG. 9, the bridge member 230 is shown in a fully closed position wherein the bridge member 230 bridges each of the terminals 220, 222, 224, thereby providing electrical continuity between all of the conductors 20, 22, 24. In a further position as shown in FIG. 10, the bridge member 230 is in a further closed position wherein the bridge member 230 bridges the terminals 220 and 224, thereby providing electrical continuity only between the conductor members 20 and 24. In a still further closed position as shown in FIG. 11, the bridge member 230 bridges the terminals 222 and 224 thereby providing electrical continuity only between the conductor members 22 and 24.

The splice connector assembly 200 may be used in the various locations and applications as described above for the splice connector assembly 100. It is particularly contemplated that, according to some embodiments, the conductor member 20 may be from a supply or telecommunications facility, with the conductor members 20 and 22 being two different lines of a customer facility which are intended to share a common supply signal. It will be appreciated from the discussion herein that it is not necessary to use three conductor members (i.e., one of the terminals 220, 222, 224 may remain vacant.)

In accordance with some preferred embodiments and as illustrated above, the terminals of the splice connector assemblies 100, 200 may all be IDCs. However, it is not necessary that all such terminals be IDCs, or that all such terminals be adapted to crimp the received conductor members. Additionally, some of the conductor members may be installed by other means, such as by pre-molding during manufacture of the connector assembly.

The foregoing and other embodiments of the present invention may include a moisture resistant gel. Such gel may be injected into the splice connector assembly prior to or following assembly. According to some embodiments, the gel preferably surrounds each of the terminals to reduce corrosive degradation of the electrical connection. Suitable gels are available from 3M Company of Minnesota.

According to some embodiments, splice connector assemblies according to the present invention (such as the splice connector assemblies 100, 200) are adapted to receive, connect and secure telecommunications wires sized in the range of from about 24 to 22 AWG.

Embodiments of splice connector assemblies according to the present invention as described above including multiple splice locations such that the two conductor members of each conductor pair are received on opposed sides of the splice connector assembly (e.g., sides 112A and 112B, respectively, of the splice connector assembly 100) may be particularly advantageous in some applications. A number of side-by-side supply wires may be efficiently and accurately paired and spliced with a number of output wires with reduced wire handling. In particular, such an arrangement may minimize or eliminate the need for individual wire placement.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

What is claimed is:

1. A splice connector assembly for mechanically and selectively electrically connecting first and second conductor members, the splice connector assembly comprising:

a) a connector body adapted to receive the first and second conductor members, the connector body including a first body member and a second body member adapted to engage the first body member;

b) first and second electrically conductive terminals in the connector body adapted to electrically engage the first and second conductor members, respectively; and c) an electrically conductive bridge member mounted in the connector body such that the bridge member is movable relative to the first and second body members between a closed position, wherein the bridge member electrically connects the first and second terminals and thereby the first and second conductor members, and an open position, wherein the bridge member does not electrically connect the first and second terminals so that the first and second conductor members are not electrically connected by the splice connector assembly;

d) wherein the splice connector assembly is arranged and configured to crimp the first conductor member to the first terminal when the first and second body members are brought into engagement with one another with the first conductor member positioned therebetween.

2. The splice connector assembly of claim 1 wherein the first and second terminals are each secured to the connector body.

3. The splice connector assembly of claim 1 wherein the connector body defines a cavity to receive the first conductor member and the first terminal.

4. The splice connector assembly of claim 1 wherein the bridge member is spring-biased into contact with the first and second terminals when the bridge member is in the closed position.

5. The splice connector assembly of claim 1 wherein the first and second body members are each formed of a polymeric material.

6. The splice connector assembly of claim 1 adapted to mechanically and selectively electrically connect at least ten pairs of conductor pairs, the splice connector assembly including a separate bridge member for each conductor pair.

7. The splice connector assembly of claim 1 wherein the first terminal includes an insulation displacement connector.

8. The splice connector assembly of claim 7 wherein the first body member, the second body member, and the first terminal are relatively arranged and configured to push the first conductor member into the insulation displacement connector when the first body member and the second body member are forced into engagement with the first conductor member positioned therebetween.

9. The splice connector assembly of claim 1 wherein the splice connector assembly is arranged and configured to crimp the second conductor member to the second terminal.

10. The splice connector assembly of claim 9 wherein the second terminal includes a second insulation displacement connector.

11. The splice connector assembly of claim 10 wherein:

a) the connector body includes a third body member adapted to engage the first body member; and b) the splice connector assembly is arranged and configured to crimp the second conductor member to the second terminal when the first and third body members are engaged with the second conductor member positioned therebetween.

12. The splice connector assembly of claim 11 wherein the first and second terminals extend from opposite sides of the first body member.

13. The splice connector assembly of claim 11 wherein the second terminal includes a second insulation displacement connector.

14. The splice connector assembly of claim 1 further including:

a) third and fourth electrically conductive terminals in the connector body adapted to electrically engage third and fourth conductor members, respectively; and b) a second electrically conductive bridge member mounted in the connector body such that the second bridge member is movable between a closed position, wherein the bridge member electrically connects the third and fourth terminals and thereby the third and fourth conductor members, and an open position, wherein the second bridge member does not electrically connect the third and fourth terminals so that the third and fourth conductor members are not electrically connected by the splice connector assembly;

c) wherein the splice connector assembly is arranged and configured to crimp the third conductor member to the third terminal when the first and second body members are engaged with the third conductor member positioned therebetween.

15. The splice connector assembly of claim 14 wherein the third terminal includes a third insulation displacement connector.

16. The splice connector assembly of claim 14 wherein the second bridge member is spring biased into contact with the third and fourth terminals when the bridge member is in the closed position.

17. The splice connector assembly of claim 14 wherein the second bridge member is rotatably mounted in the connector body such that the second bridge member can be rotated between the open and closed positions.

18. The splice connector assembly of claim 14 wherein the second bridge member is mounted in the connector body such that the second bridge member can be translated between the open and closed positions.

19. The splice connector assembly of claim 14 wherein:

a) the connector body includes a third body member adapted to engage the first body member; and b) the splice connector assembly is arranged and configured to crimp the second and fourth conductor members to the second and fourth terminals, respectively, when the first and third body members are engaged with the second and fourth conductor members positioned therebetween.

20. The splice connector assembly of claim 19 wherein the first and third terminals extend from a first side of the first body member and the second and fourth terminals extend from a second side of the first body member opposite the first side.

21. The splice connector assembly of claim 19 wherein the second and fourth terminals include a second insulation displacement connector and a fourth insulation displacement connector, respectively.

22. The splice connector assembly of claim 1 wherein the bridge member is mounted in the connector body such that the bridge member can be translated between the open and closed positions.

23. The splice connector assembly of claim 22 including a tab member operatively connected to the bridge member and accessible from exteriorly of the connector body.

24. The splice connector assembly of claim 1 wherein the bridge member is rotatably mounted in the connector body such that the bridge member can be rotated between the open and closed positions.

25. The splice connector assembly of claim 24 wherein:

a) the splice connector assembly includes a third terminal in the connector body adapted to electrically engage a third conductor;

b) when the bridge member is in the closed position, the bridge member does not electrically connect the third terminal with at least one of the first and second terminals; and c) the bridge member is rotatable to a second closed position wherein the bridge member electrically connects each of the first, second and third terminals.

26. The splice connector assembly of claim 24 wherein the bridge member comprises a swivel plate that is rotatably mounted on a pivot member such that the bridge member is rotatable between the open and closed positions by rotating the pivot member.

27. The splice connector assembly of claim 26 wherein the pivot member is adapted to engage a drive tool.

28. A method for splicing and selectively electrically connecting and disconnecting first and second conductor members using a splice connector assembly including a connector body and first and second electrically conductive terminals and a bridge member mounted in the connector body, the connector body including first and second body members, the method comprising:

a) inserting the first and second conductor members into the connector body between the first and second body members;

b) electrically engaging the first and second conductor members with the first and second terminals, respectively;

c) electrically connecting the first and second conductor members by placing the bridge member in a closed position wherein the bridge member electrically connects the first and second terminals; and thereafter d) electrically disconnecting the first and second conductors by moving the bridge member relative to the first and second body members into an open position wherein the bridge member does not electrically connect the first and second terminals;

e) wherein the step of engaging the first and second conductor members with the first and second terminals includes bringing the first and second body members into engagement with one another such that the first conductor member is thereby crimped to the first terminal.

29. The method of claim 28 wherein:

a) the first terminal is an insulation displacement connector; and b) the step of engaging the first and second conductor members with the first and second terminals includes forcing the first conductor member into the insulation displacement connector.

30. The method of claim 28 including rotating the bridge member to electrically connect and/or disconnect the first and second terminals.

31. The method of claim 28 including translating the bridge member to electrically connect and/or disconnect the first and second terminals.

32. A splice connector assembly for mechanically and selectively electrically connecting first and second conductor members, the splice connector assembly comprising:

a) a connector body adapted to receive the first and second conductor members;

b) first and second electrically conductive terminals in the connector body adapted to electrically engage the first and second conductor members, respectively;

c) third and fourth electrically conductive terminals in the connector body adapted to electrically engage third and fourth conductor members, respectively;

d) an electrically conductive first bridge member mounted in the connector body such that the first bridge member is movable between a closed position, wherein the first bridge member electrically connects the first and second terminals and thereby the first and second conductor members, and an open position, wherein the first bridge member does not electrically connect the first and second terminals so that the first and second conductor members are not electrically connected by the splice connector assembly;

e) a second electrically conductive bridge member mounted in the connector body such that the second bridge member is movable between a closed position, wherein the second bridge member electrically connects the third and fourth terminals and thereby the third and fourth conductor members, and an open position, wherein the second bridge member does not electrically connect the third and fourth terminals so that the third and fourth conductor members are not electrically connected by the splice connector assembly;

f) wherein the first terminal includes a first insulation displacement connector; and g) wherein the third terminal includes a third insulation displacement connector.

33. The splice connector assembly of claim 32 wherein the second terminal includes a second insulation displacement connector.

34. The splice connector assembly of claim 32 wherein the first and second terminals extend from opposite sides of the first body member.

35. The splice connector assembly of claim 32 wherein the first and third terminals extend from a first side of the first body member and the second and fourth terminals extend from a second side of the first body member opposite the first side.

36. The splice connector assembly of claim 32 wherein the first bridge member is mounted in the connector body such that the first bridge member can be translated between the open and closed positions.

37. The splice connector assembly of claim 32 wherein the first bridge member is rotatably mounted in the connector body such that the first bridge member can be rotated between the open and closed positions.

38. A method for splicing and selectively electrically connecting and disconnecting first and second conductor members using a splice connector assembly including a connector body and first and second electrically conductive terminals and a bridge member mounted in the connector body, the method comprising:

a) inserting the first and second conductor members into the connector body;

b) electrically engaging the first and second conductor members with the first and second terminals, respectively;

c) electrically connecting the first and second conductor members by placing the bridge member in a closed position wherein the bridge member electrically connects the first and second terminals; and thereafter d) electrically disconnecting the first and second conductors by placing the bridge member in an open position wherein the bridge member does not electrically connect the first and second terminals; and e) rotating the bridge member to electrically connect and/or disconnect the first and second terminals;

f) wherein the first terminal includes an insulation displacement connector, and the step of engaging the first and second conductor members with the first and second terminals includes forcing the first conductor member into the insulation displacement connector.

39. A splice connector assembly for mechanically and selectively electrically connecting first and second conductor members, the splice connector assembly comprising:

a) a connector body adapted to receive the first and second conductor members, the connector body including a first body member and a second body member adapted to engage the first body member;

b) first and second electrically conductive terminals in the connector body adapted to electrically engage the first and second conductor members, respectively;

c) third and fourth electrically conductive terminals in the connector body adapted to electrically engage third and fourth conductor members, respectively;

d) an electrically conductive first bridge member mounted in the connector body such that the first bridge member is movable between a closed position, wherein the first bridge member electrically connects the first and second terminals and thereby the first and second conductor members, and an open position, wherein the first bridge member does not electrically connect the first and second terminals so that the first and second conductor members are not electrically connected by the splice connector assembly; and e) a second electrically conductive bridge member mounted in the connector body such that the second bridge member is movable between a closed position, wherein the bridge member electrically connects the third and fourth terminals and thereby the third and fourth conductor members, and an open position, wherein the second bridge member does not electrically connect the third and fourth terminals so that the third and fourth conductor members are not electrically connected by the splice connector assembly;

f) wherein the splice connector assembly is arranged and configured to crimp the first conductor member to the first terminal when the first and second body members are engaged with the first conductor member positioned therebetween; and g) wherein the splice connector assembly is arranged and configured to crimp the third conductor member to the third terminal when the first and second body members are engaged with the third conductor member positioned therebetween.

40. The splice connector assembly of claim 39 wherein the third terminal includes a third insulation displacement connector.

41. The splice connector assembly of claim 39 wherein the second bridge member is spring biased into contact with the third and fourth terminals when the bridge member is in the closed position.

42. The splice connector assembly of claim 39 wherein the second bridge member is rotatably mounted in the connector body such that the second bridge member can be rotated between the open and closed positions.

43. The splice connector assembly of claim 39 wherein the second bridge member is mounted in the connector body such that the second bridge member can be translated between the open and closed positions.

44. The splice connector assembly of claim 39 wherein:

a) the connector body includes a third body member adapted to engage the first body member; and b) the splice connector assembly is arranged and configured to crimp the second and fourth conductor members to the second and fourth terminals, respectively, when the first and third body members are engaged with the second and fourth conductor members positioned therebetween.

45. The splice connector assembly of claim 44 wherein the first and third terminals extend from a first side of the first body member and the second and fourth terminals extend from a second side of the first body member opposite the first side.

46. The splice connector assembly of claim 44 wherein the second and fourth terminals include a second insulation displacement connector and a fourth insulation displacement connector, respectively.

47. A splice connector assembly for mechanically and selectively electrically connecting first and second conductor members, the splice connector assembly comprising:

a) a connector body adapted to receive the first and second conductor members, the connector body including a first body member and a second body member adapted to engage the first body member;

b) first and second electrically conductive terminals in the connector body adapted to electrically engage the first and second conductor members, respectively; and c) an electrically conductive bridge member mounted in the connector body such that the bridge member is movable between a closed position, wherein the bridge member electrically connects the first and second terminals and thereby the first and second conductor members, and an open position, wherein the bridge member does not electrically connect the first and second terminals so that the first and second conductor members are not electrically connected by the splice connector assembly;

d) wherein the splice connector assembly is arranged and configured to crimp the first conductor member to the first terminal when the first and second body members are engaged with the first conductor member positioned therebetween; and e) wherein the bridge member is rotatably mounted in the connector body such that the bridge member can be rotated between the open and closed positions.

48. The splice connector assembly of claim 47 wherein:

a) the splice connector assembly includes a third terminal in the connector body adapted to electrically engage a third conductor;

b) when the bridge member is in the closed position, the bridge member does not electrically connect the third terminal with at least one of the first and second terminals; and c) the bridge member is rotatable to a second closed position wherein the bridge member electrically connects each of the first, second and third terminals.

49. The splice connector assembly of claim 47 wherein the bridge member comprises a swivel plate that is rotatably mounted on a pivot member such that the bridge member is rotatable between the open and closed positions by rotating the pivot member.

50. The splice connector assembly of claim 49 wherein the pivot member is adapted to engage a drive tool.

51. A splice connector assembly for mechanically and selectively electrically connecting first and second conductor members, the splice connector assembly comprising:

a) a connector body adapted to receive the first and second conductor members, the connector body including a first body member and a second body member adapted to engage the first body member;

b) first and second electrically conductive terminals in the connector body adapted to electrically engage the first and second conductor members, respectively; and c) an electrically conductive bridge member mounted in the connector body such that the bridge member is movable between a closed position, wherein the bridge member electrically connects the first and second terminals and thereby the first and second conductor members, and an open position, wherein the bridge member does not electrically connect the first and second terminals so that the first and second conductor members am not electrically connected by the splice connector assembly;

d) wherein the splice connector assembly is arranged and configured to crimp the first conductor member to the first terminal when the first and second body members are engaged with the first conductor member positioned therebetween; and e) wherein the splice connector assembly is adapted to mechanically and selectively electrically connect at least ten pairs of conductor pairs, the splice connector assembly including a separate bridge member for each conductor pair.

52. A method for splicing and selectively electrically connecting and disconnecting first and second conductor members using a splice connector assembly including a connector body and first and second electrically conductive terminals and a bridge member mounted in the connector body, the connector body including first and second body member the method comprising:

a) inserting the first and second conductor members into the connector body between the first and second body members;

b) electrically engaging the first and second conductor members with the first and second terminals, respectively;

c) electrically connecting the first and second conductor members by placing the bridge member in a closed position wherein the bridge member electrically connects the first and second terminals; and thereafter d) electrically disconnecting the first and second conductors by placing the bridge member in an open position wherein the bridge member does not electrically connect the first and second terminals; and e) rotating the bridge member to electrically connect and/or disconnect the first and second terminals;

f) wherein the step of engaging the first and second conductor members with the first and second terminals includes engaging the first and second body members such that the first conductor member is crimped to the first terminal.

53. A splice connector assembly for mechanically and selectively electrically connecting first and second conductor members, the splice connector assembly comprising:

a) a connector body adapted to receive the first and second conductor members;

b) first and second electrically conductive terminals in the connector body adapted to electrically engage the first and second conductor members, respectively; and c) an electrically conductive bridge member mounted in the connector body such that the bridge member is movable between a closed position, wherein the bridge member electrically connects the first and second terminals and thereby the first and second conductor members, and an open position, wherein the bridge member does not electrically connect the first and second terminals so that the first and second conductor members are not electrically connected by the splice connector assembly;

d) wherein the first terminal includes an insulation displacement connector; and e) wherein the bridge member is rotatably mounted in the connector body such that the bridge member can be rotated between the open and closed positions.

* * * * *